United States Patent [19]

English et al.

[11] Patent Number: 4,864,180

[45] **Date of Patent: * Sep. 5, 1989**

[54] METAL-HALIDE ARC TUBE AND LAMP HAVING IMPROVED UNIFORMITY OF AZIMUTHAL LUMINOUS INTENSITY

[75] Inventors: George J. English, Reading; Harold L. Rothwell, Jr., Georgetown; Thomas Gilligan, Salisbury, all of Mass.

[73] Assignee: GTE Products Corporation, Danvers, Mass.

[ * ] Notice: The portion of the term of this patent subsequent to Apr. 18, 2006 has been disclaimed.

[21] Appl. No.: 112,645

[22] Filed: Oct. 26, 1987

Related U.S. Application Data

[63] Continuation-in-part of Ser. No. 909,359, Sep. 18, 1986, Pat. No. 4,823,050.

[51] Int. Cl.[4] ..... H01J 61/073; H01J 61/35; H01J 61/52

[52] U.S. Cl. ..... 313/44; 313/25; 313/620; 313/635

[58] Field of Search ..... 313/17, 25, 44, 620, 313/634, 635, 631, 632

[56] References Cited

U.S. PATENT DOCUMENTS 4,161,672 7/1979 Cap et al. ..... 313/620
4,422,004 12/1983 Knecht ..... 313/25
4,503,356 3/1985 Kobayashi et al. ..... 313/634
4,823,050 4/1989 English et al. ..... 313/634

*Primary Examiner*—Kenneth Wieder
*Attorney, Agent, or Firm*—Joseph S. Romanow

[57] ABSTRACT

A metal-halide arc tube and lamp having improved uniformity of azimuthal luminous intensity and being particularly suited for navigational signal applications. The arc tube when operationally positioned about a vertical axis has a body which is substantially egg-shaped with the lower half of the body being more oblate than the upper half. During operation, the surface of the upper half of the arc tube body remains entirely free of metal-halide condensate so that no emitted light is blocked by condensate in any direction and nearly uniform azimuthal intensity is achieved. A heat-reflecting coating about the lower electrode prevents the formation of a condensate puddle about the lower electrode and relocates the condensate during operation to an area of the lower half above the coating and below the center of the arc tube. The arc tube may be seasoned during initial startup so that all of the additive remains solidified and bonded to a surface of the lower half of the arc tube during shipping and installation of the lamp. Preferred embodiments of the invention are disclosed which are designed for a coastal signal beacon. In addition to nearly uniform azimuthal intensity, the invention provides the advantages of greater range, wider beam width, longer life, improved efficiency, and equivalent or greater ruggedness for use in an all weather environment in comparison with the prior art.

12 Claims, 10 Drawing Sheets

METAL-HALIDE ARC TUBE AND LAMP HAVING IMPROVED UNIFORMITY OF AZIMUTHAL LUMINOUS INTENSITY

GOVERNMENT INTEREST IN INVENTION

The Government has rights in this invention pursuant to Contract No. DTCG23-84-C-20027 awarded by the United States Coast Guard.

This is a continuation in part of Ser. No. 909,359, filed Sept. 18, 1986, assigned to the assignee hereof now U.S. Pat. No. 4,823,050 issued Apr. 18, 1989.

CROSS REFERENCES TO RELATED APPLICATIONS

United States design patent application, having U.S. Ser. No. 909,459 filed Sept. 18, 1986 assigned to the assignee hereof, contains related subject matter. U.S. Ser. No. 112,646 now U.S. Pat. No. 4,847,530 filed concurrently herewith, and assigned to the assignee hereof, contains related subject matters.

TECHNICAL FIELD

This invention relates to metal-halide arc discharge tubes for vertical operation and lamps employing same, and more particularly to such arc tubes and lamps wherein uniform luminous intensity in an azimuthal plane is important, such as in navigational signal lights.

BACKGROUND ART

Light sources having nearly uniform azimuthal luminous intensity have various applications, one of which is navigational signal lighting. Although filament lamps have been heavily relied on in the past for navigational signal lighting, modern light sources, more particularly arc discharge sources, will undoubtedly be employed in increasing numbers in the future because of the many advantages offered by these light sources. An arc discharge lamp generally provides better efficacy and longer life than its incandescent counterpart. The electrodes are heavier than the filament, so that the lamp may be more rugged. In an arc discharge lamp, the length and width of the arc are design variables to a large extent. In an incandescent lamp, the length and width of the filament are for the most part determined by the lamp wattage. Thus, there is greater flexibility in the choice of optical characteristics of the light source with arc discharge lamps than with comparable incandescent lamps. This is a significant factor in signal lighting, particularly with lamps of three hundred watts or less.

The principal object of a signal light is to emit as much light flux as possible from a reliable light source and direct the light into the plane of the horizon. The light may be radiated in all horizontal directions simultaneously, or it may be collected into one or more narrow beams which are mechanically rotated. There are basically two types of rotating beams or beacons. In the first type, a reflector or other means of concentrating the light is used with the lamp. The entire optical system is rotated. This method generally produces a single beam; all of the emitted light is swept through 360 degrees. In the second type, a rotating screen surrounds a stationary lamp. The screen contains multiple lenses or other means for concentrating light. This method generally produces multiple rotating beams, one beam associated with each lens or sector subtended by a lens. The emitted light within any sector is formed into a pencil beam and swept only within that sector.

The observable range of a signal light is directly related to the luminous intensity emitted in the direction of the observer. Where the signal emanates in all directions simultaneously, it is highly desirable for the luminous intensity to be uniform so that the effective range of the signal will be independent of the position of the observer. In the case of a single rotating beam, uniformity of luminous intensity is not as critical because of the integrating effect of the reflector. In the case of multiple beams, uniformity of luminous intensity again is critical, because the integrating effect of a lens is limited to the sector subtended by the lens.

It would be an advancement of the art if an arc discharge lamp could be provided which is well suited for navigational signal applications and, in particular, has improved uniformity of azimuthal luminous intensity.

DISCLOSURE OF THE INVENTION

It is, therefore, an object of the invention to obviate the deficiencies of the prior art.

It is another object of the invention to provide a metal-halide arc tube and lamp having improved uniformity of azimuthal luminous intensity.

A further object of the invention is to provide a metal-halide arc tube and lamp which are well suited for navigational signal lighting applications.

Yet another object of the invention is to provide a metal-halide arc tube and lamp for vertical operation wherein during operation of the lamp metal-halide condensate appears only on the walls of the arc tube below the plane of the horizon.

Still further objects of the invention are to provide an arc discharge light source for an existing navigational signal beacon which has greater range, wider beam width, longer life, better efficacy, and equivalent or better ruggedness than its filament counterpart in the prior art.

These objects are accomplished, in one aspect of the invention, by provision of an arc tube for vertical operation having improved uniformity of azimuthal luminous intensity. The arc tube has a vertical axis and an azimuthal plane normal to the vertical axis.

The arc tube comprises a light-transmissive body elongated along the vertical axis with opposed top and bottom ends. The bottom end is closer to the earth than the top end when the arc tube is operationally positioned. The body hermetically encloses an interior. Each of the ends has an electrode mounted therein. Each electrode protrudes into the interior substantially along the vertical axis. The azimuthal plane passes half way between the internal termination points of the electrodes. The portion of the body below the azimuthal plane is more oblate than the portion of the body above the azimuthal plane.

The body is divided into three regions, all being symmetrical about the vertical axis. A top region extends from the top end to a point on the body below the azimuthal plane. A bottom region extends from the bottom end toward the top region. A middle region is defined as being intermediate the bottom and top regions.

There is a heat reflecting coating on the outside surface of the bottom region. A gaseous fill is disposed within the interior. The gaseous fill is capable of sustaining an electrical arc therethrough.

Also disposed within the interior is an additive which includes at least one metal-halide. During operation of the arc tube, the inside surface of the top region is substantially free of the additive in condensate form.

The objects are accomplished, in another aspect of the invention, by the provision of a metal-halide arc discharge lamp employing an arc tube in accordance with the invention. The arc tube is mounted within a hermetically sealed light-transmissive outer envelope.

A metal-halide arc tube or lamp constructed as described above will produce substantially improved uniformity of azimuthal luminous intensity. Also, such an arc tube or lamp will be particularly well suited for use in navigational signal lighting applications.

FIG. is an elevational view of a lamp in accordance with the invention, such lamp being single-ended with a bi-post base.

Figure 3:
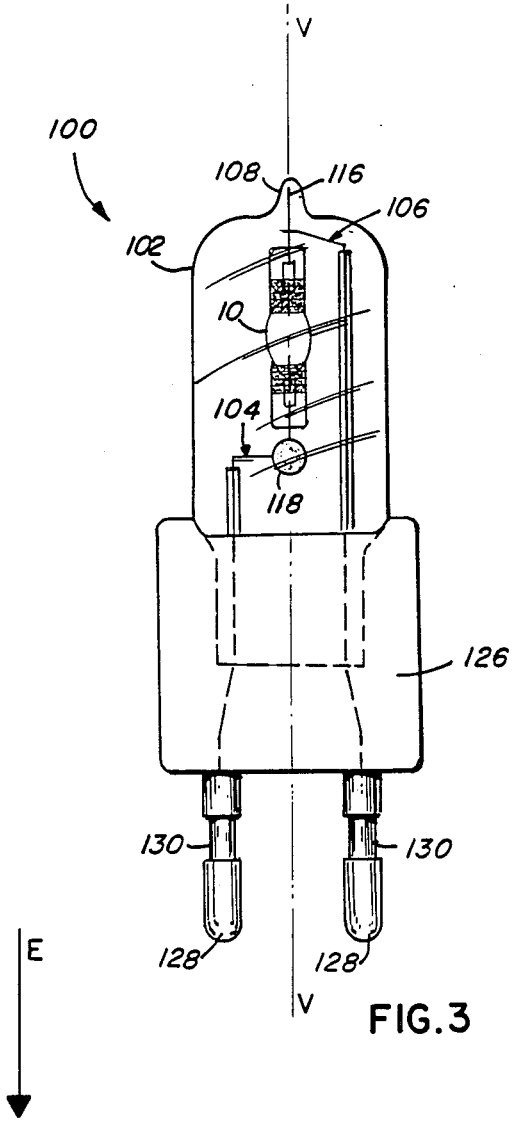
Figure 4:
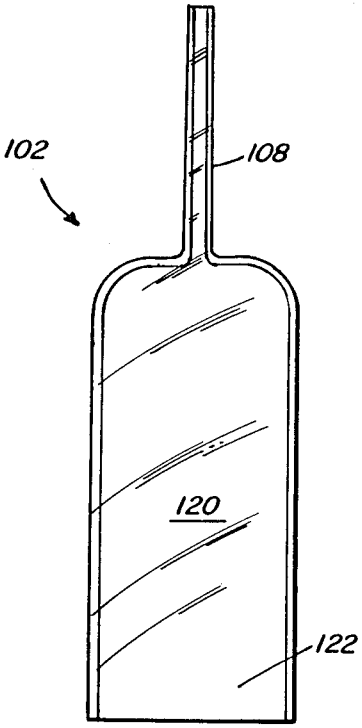

FIG. 4 is an elevational view of the outer envelope and exhaust tubulation for a lamp of FIG. 3 before an arc tube has been mounted within the outer envelope.

Figure 5:
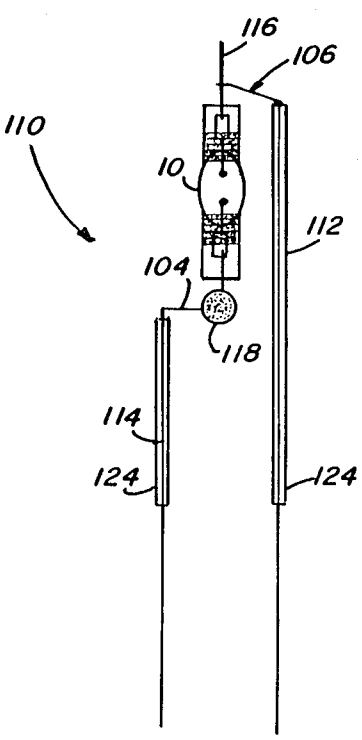

FIG. 5 is an elevational view of the arc tube and lead-in wires for a lamp of FIG. 3 before they have been mounted within the outer envelope of FIG. 4.

Figure 6:
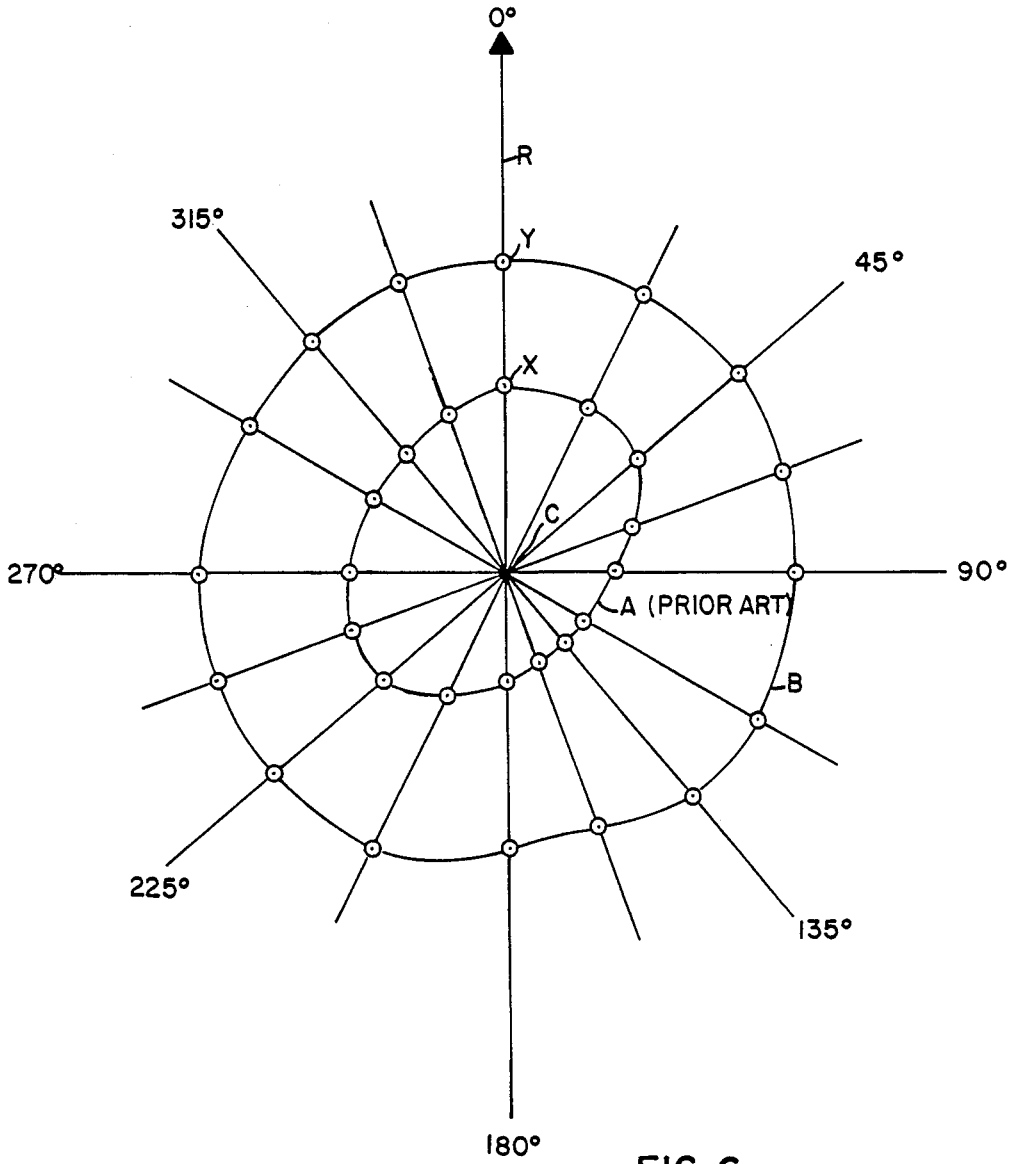

FIG. 6 contains plots in polar coordinates of azimuthal luminous intensity of the light source for a 45 watt embodiment of the invention as shown in FIG. 3 (Plot B), and its prior art counterpart (Plot A).

Figure 7:
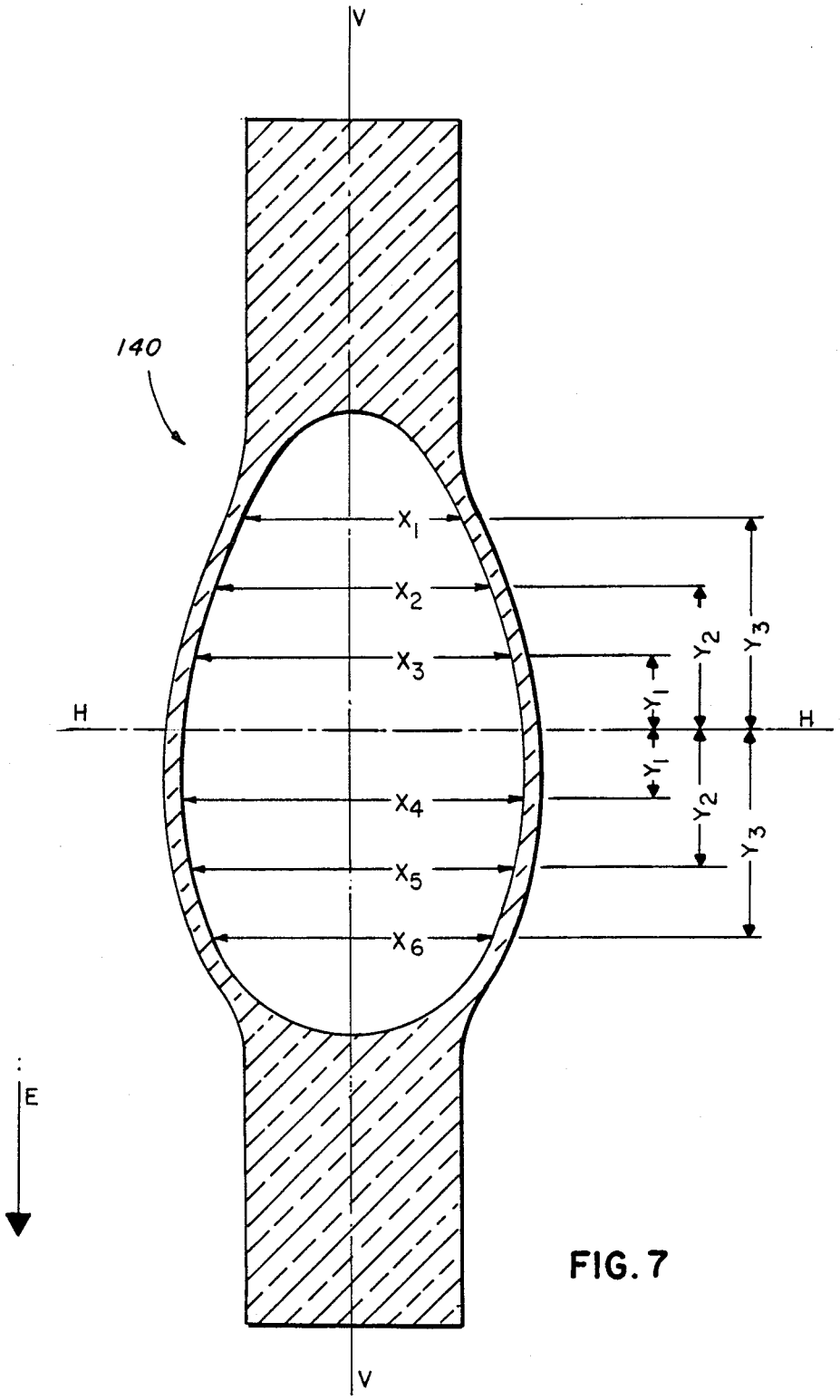

FIG. 7 is an enlarged elevational cross-sectional view showing specific dimensions of a preferred embodiment of an arc tube to which Plot B of FIG. 6 pertains.

Figure 8:
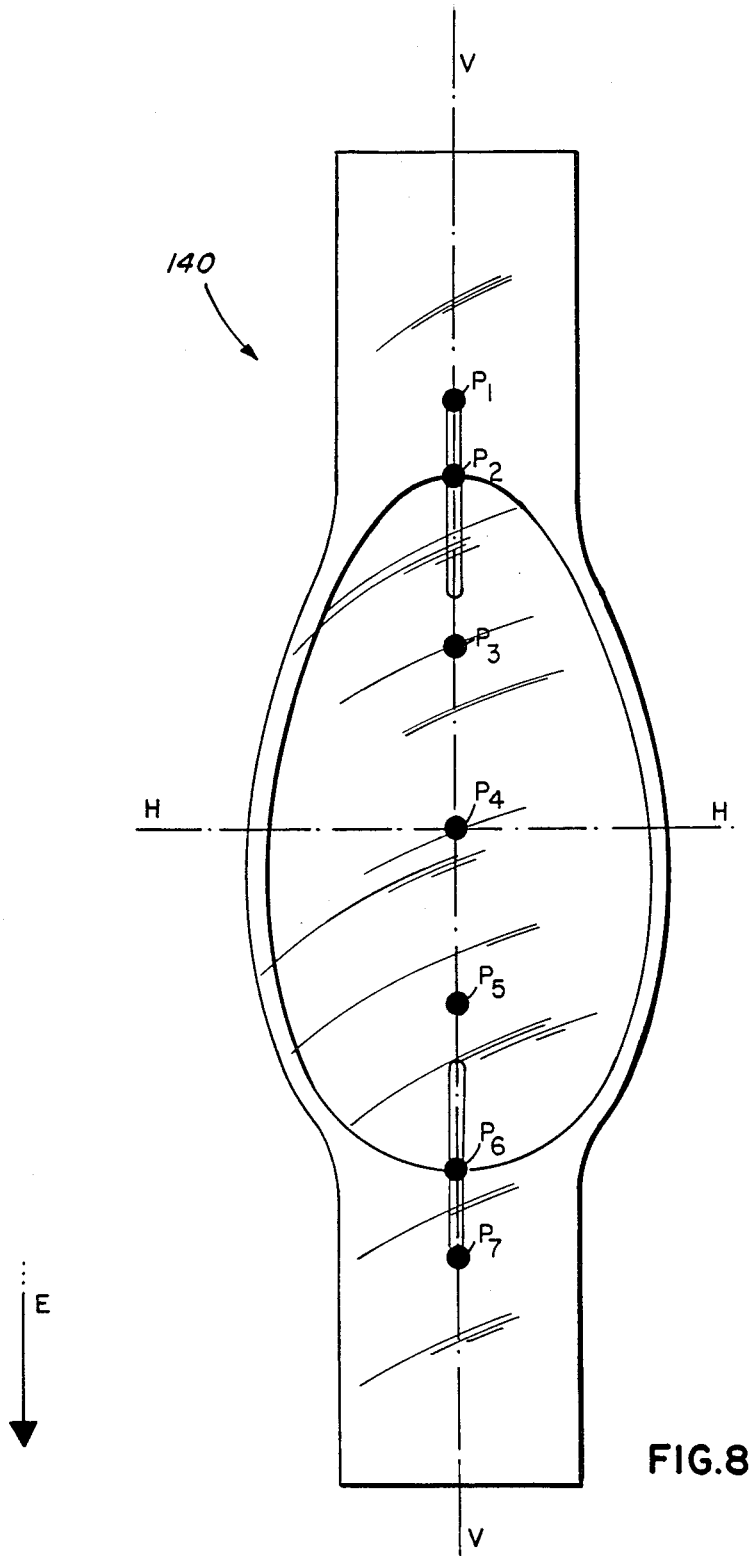

FIG. 8 is an enlarged elevational view of an arc tube of FIG. 7 showing steady state operating temperatures at seven designated points on the surface of the arc tube, there being no heat-reflecting coating on either end of the arc tube.

Figure 9:
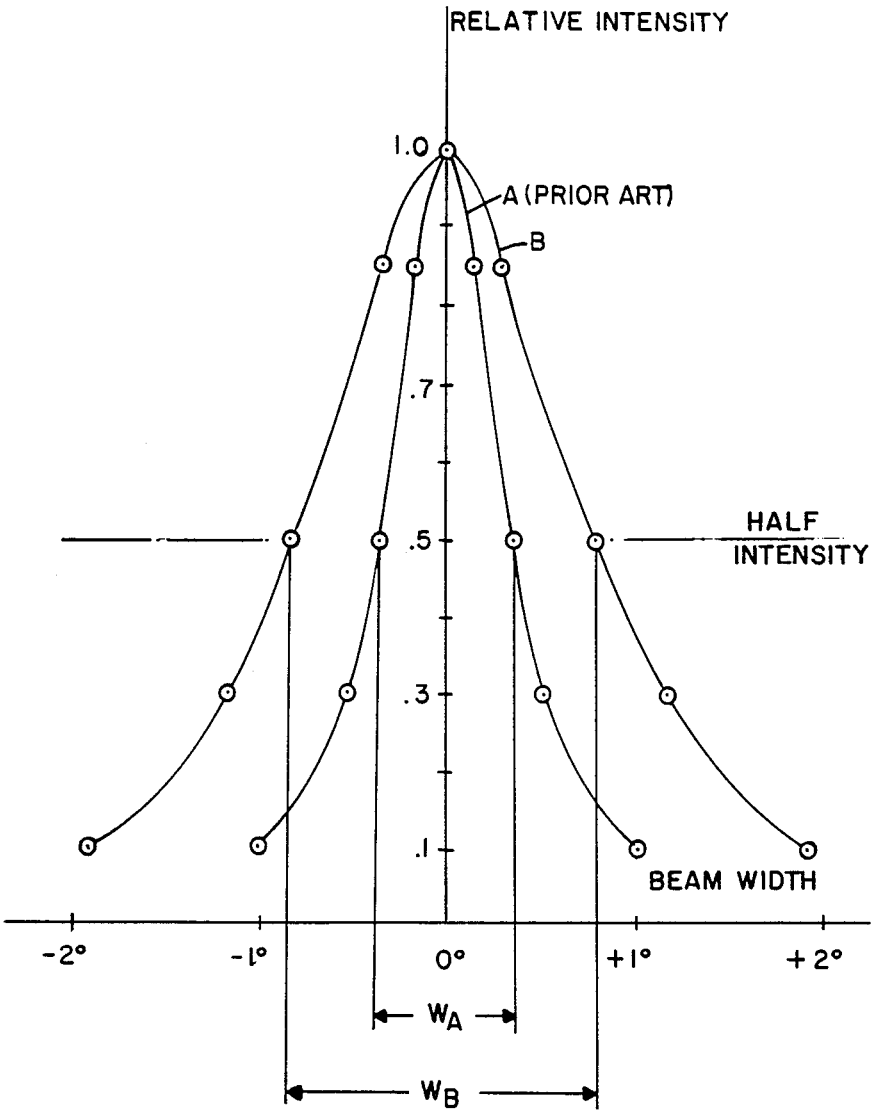

FIG. 9 shows relative luminous intensity distributions measured horizontally across two beams of a signal beacon, one beam being emitted from a light source from the prior art, the other beam being emitted from a light source as shown in FIG. 3.

Figure 10:
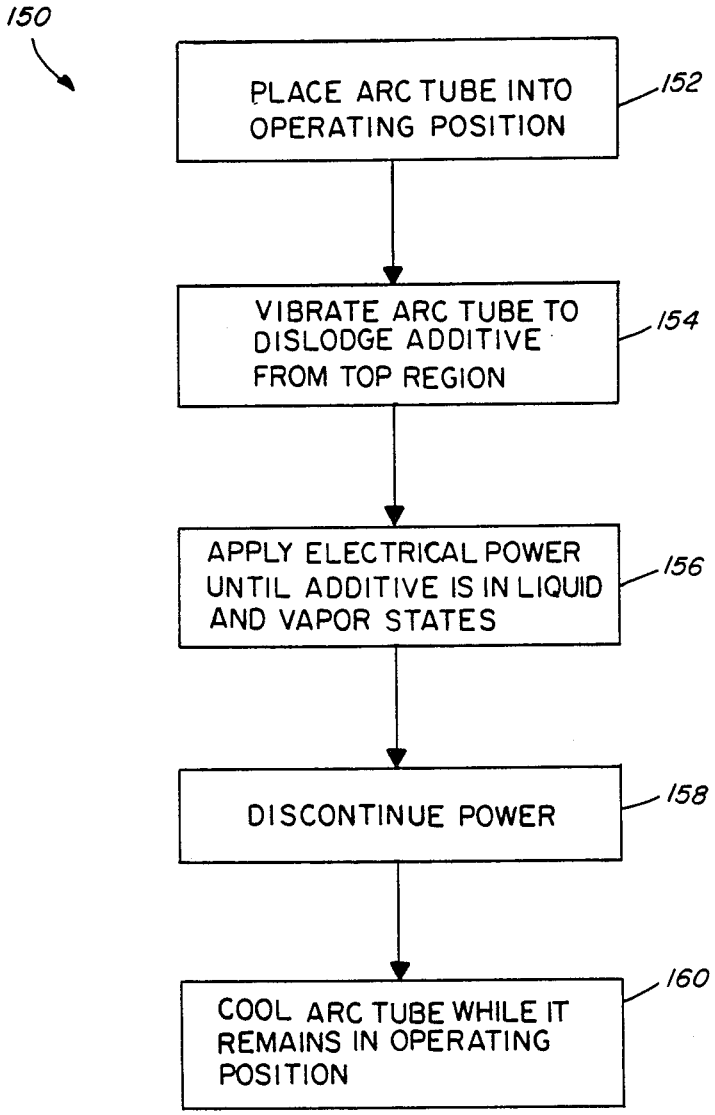

FIG. 10 is a block diagram of a method of seasoning an arc tube in accordance with the invention.

Figure 1:
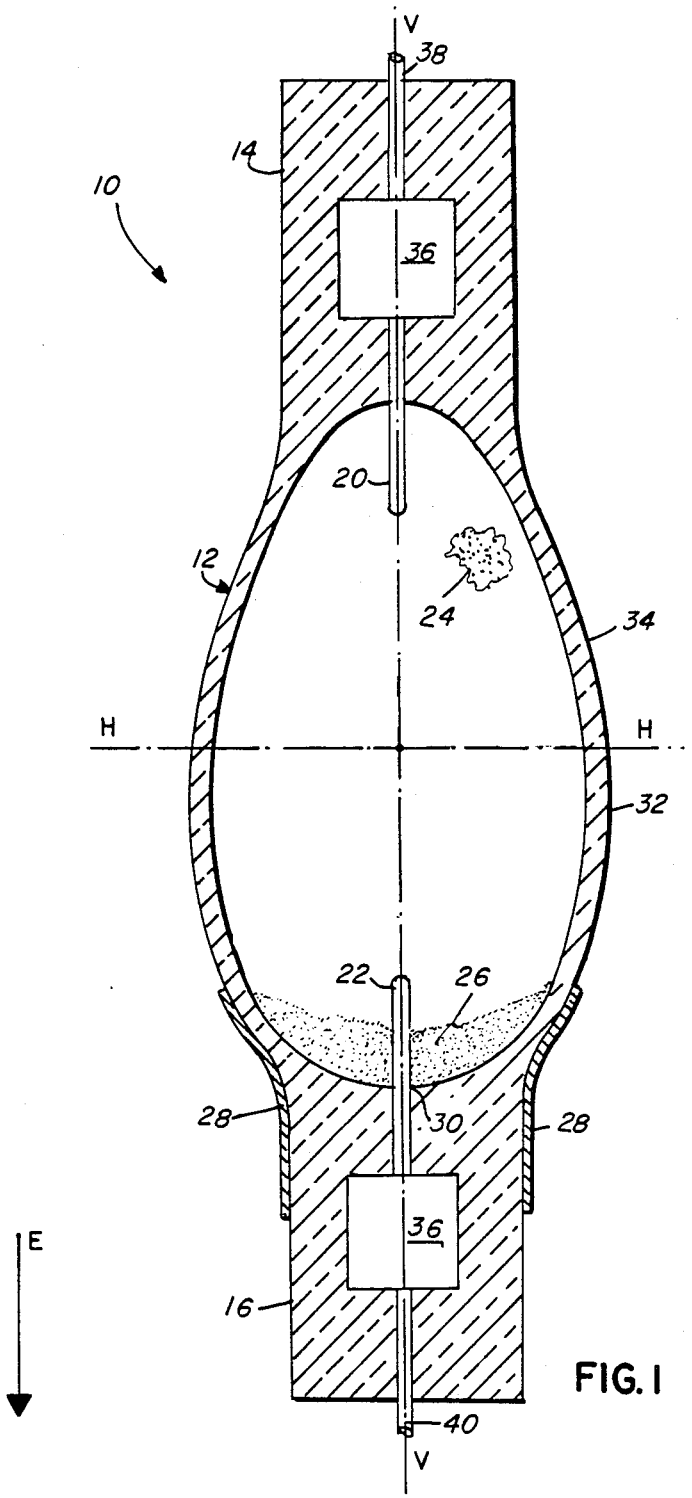
FIG. 1 is an enlarged cross-sectional view of an arc tube in accordance with the invention. The arc tube is shown in its vertical operating position with the Portion of the arc tube below the horizontal plane being more oblate than the upper portion.
Figure 11:
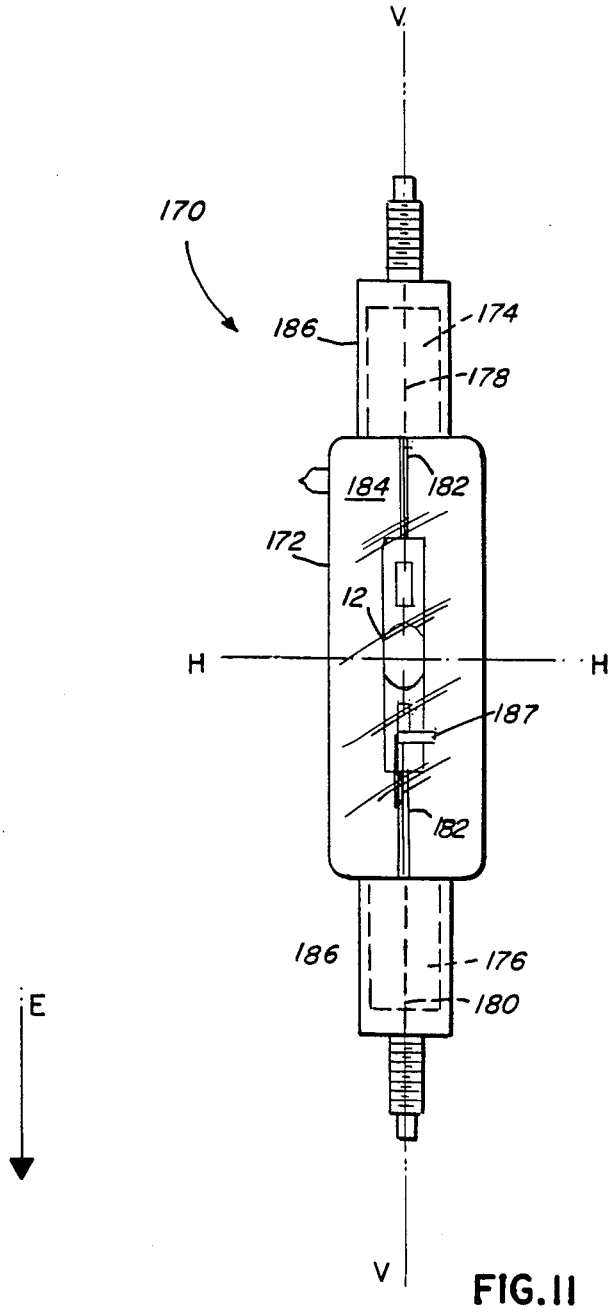

FIG. 11 is an elevational view of a double-ended embodiment of the invention employing an arc tube as shown in FIG. 1.

BEST MODE FOR CARRYING OUT THE INVENTION

For a better understanding of the present invention, together with other and further objects, features, advantages, and capabilities thereof, reference is made to the following disclosure and appended claims taken in conjunction with the above-described drawings.

Obtaining nearly uniform azimuthal luminous intensity with a metal-halide arc discharge lamp is generally not possible and at best unpredictable. The problem is that metal-halide condensate on the walls of the arc tube blocks substantial amounts of light. A surplus of metal-halide additive is generally included within the arc tube to insure a sufficient supply over the life of the lamp. During operation of the lamp, a portion of the additive frequently appears in condensate form on the walls of the arc tube. This substantially reduces the luminous intensity in azimuthal directions subtended by the condensate. While this variation in intensity may be acceptable in some applications, it is a substantial problem in navigational signal applications and may be a significant problem in other fields as well.

During operation of a metal-halide lamp, the condensate will collect on the colder portions of the arc tube walls. In the invention, an arc tube and lamp have been designed for vertical operation such that the colder portions of the arc tube walls will always occur in the bottom and middle regions of the arc tube below the azimuthal plane. Therefore, the top region of the arc tube, which includes the azimuthal plane, will always be free of condensate, resulting in substantially improved uniformity of azimuthal luminous intensity.

The geometry of the arc tube is such that the portion of the arc tube body below the azimuthal plane is more oblate than the portion of the body above the azimuthal plane. Because of the greater surface area of the lower portion and the fact that heat rises, the lower portion of the arc tube will always be colder than the upper portion. A problem may develop, however, if the condensate collects in a puddle about the base of the lower electrode. When this occurs, the arc may be directed down the electrode to the point where the condensate touches the electrode. In this location, the operating arc will soften and melt the arc tube wall near the point where the electrode emerges from the wall. This problem is avoided by providing a heat-reflecting coating on the outside surface of the bottom region of the arc tube body adjacent to the bottom end. By reflecting heat into the bottom region, the coldest areas of the inside surface of the arc tube will be relocated to the middle region; i.e., above the heat-reflecting coating and below the azimuthal plane. Consequently, during operation of the arc tube the additive in condensate form will be substantially confined to the inside walls of the middle region.

An arc tube and lamp in accordance with the invention will have applications in various fields where uniform azimuthal luminous intensity is important. The best mode will be described herein as a navigational signal lamp or beacon lamp. There is no intent, however, to limit the scope of the invention to signal applications.

The term "luminous intensity" is a measure of luminous flux per unit solid angle in a given direction. It is frequently expressed in candelas. The term "azimuth" is used herein as a measure of direction in a horizontal plane. It is generally measured in angular units from a reference direction.

FIG. 1 shows an enlarged view of arc tube 10 in cross-section taken through central vertical axis V—V. Arc tube 10 is shown in its vertical operating position with respect to arrow E which points toward the earth. Arc tube 10 comprises light-transmissive body 12 elongated along axis V—V with top end 14 opposed to bottom end 16. Body 12 hermetically encloses interior 18. Top electrode 20 is mounted in end 14 and protrudes into interior 18 along axis V—V. Bottom electrode 22 is mounted in end 16 and protrudes into interior 18 along axis V—V. The insertion depth of bottom electrode 22 is shown in the drawing as B, and the insertion depth top electrode 20 is shown as T. The insertion depth of bottom electrode 22 is the distance along axis V—V between point 30, where electrode 22 emerges from end 16 into interior 18, and internal termination 23 of electrode 22. The insertion depth of top electrode 20 is similarly defined. The gap length, G, is the distance along axis V—V between internal termination 21 and 23 of electrodes 20 and 22, respectively. The gap length between the electrodes equals the arc length in an operational lamp.

Line H—H is the trace of an azimuthal plane normal to axis V—V and passing half way between the internal termination points of electrodes 20 and 22. In practice, this azimuthal plane will be treated as the plane of the horizon since the lamp will be employed close to the surface of the earth and the observer will generally be at a relatively large distance from the lamp. Disposed within interior 18 is additive 26 including at least one metal-halide. Heat-reflecting coating 28 is disposed on the outside surface of body 12 and end 16 near point 30 where electrode 22 emerges from end 16.

Figure 2:
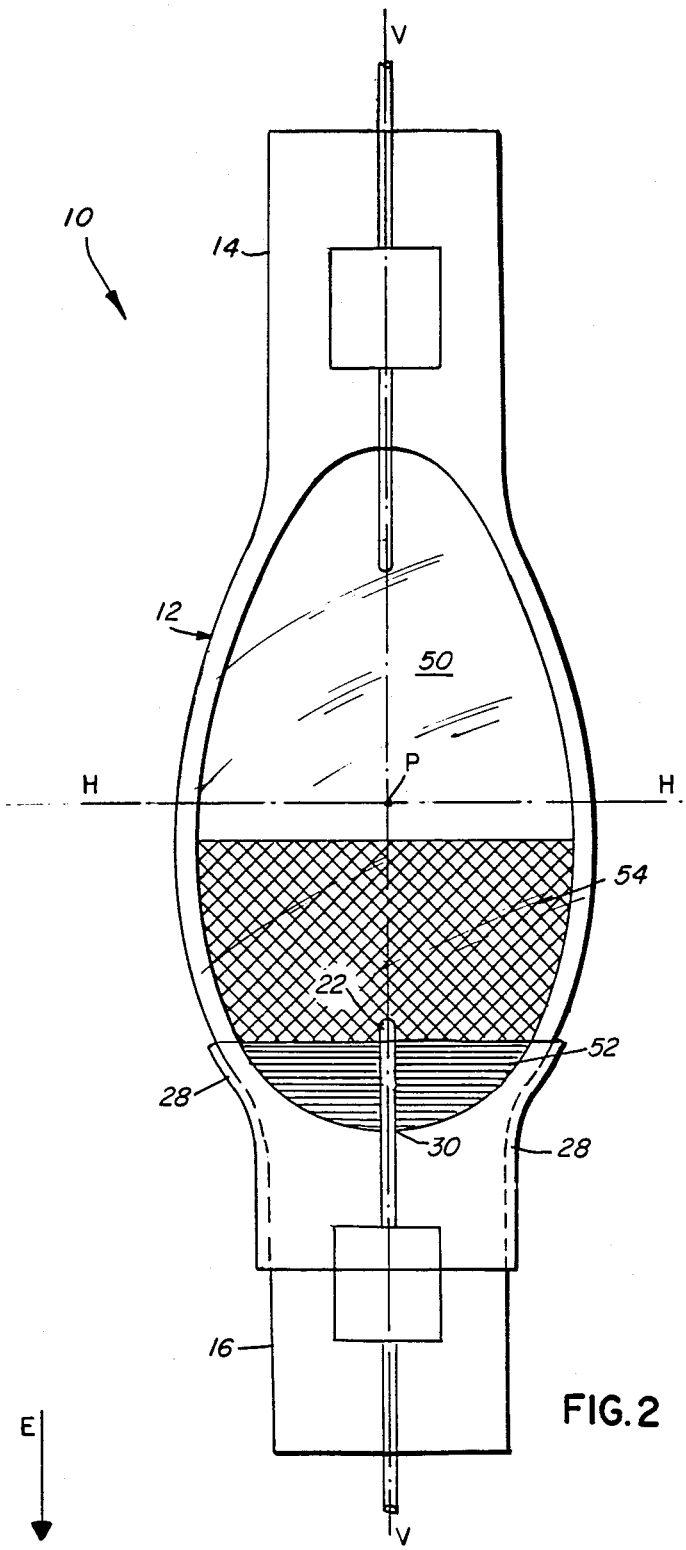
FIG. 2 is an enlarged elevational view of an arc tube of FIG. 1 showing three regions of the interior surface having different thermal characteristics during operations of the arc tube.

Lower portion 32 of body 12 below plane H—H is more oblate (with respect to axis V—V) than is upper portion 34 of body 12 above and including plane H—H. Consequently, lower portion 32 has greater surface area and cooling capacity than upper portion 34. FIG. 2 is an enlarged elevational view of arc tube 10 showing three regions of the interior surface of body 12 which have different thermal properties during operation of the arc tube. Each region is symmetrical with respect to axis V—V. Top region 50, being clear in the drawing, extends from top end 14 to a point P on body 12 below plane H—H. Bottom region 52, shown with horizontal shading in the drawing, extends from bottom end 16 toward top region 50 to the same extent as does heat-reflective coating 28. Middle region 54, shown in double cross-hatching in the drawing, is defined as being the internal surface area of body 12 between top region 50 and bottom region 52.

To insure the desired result that region 50 of arc tube 10 remains free of condensate during lamp operation, the following constraints should be adhered to. Experimentation shows that the ratios B/G and T/G each should be less than or equal to 0.5, and B should be less than or equal to T. If either insertion depth exceeds half of the gap length, there is a possibility of a cold spot at or near the juncture of the corresponding electrode and arc tube end. Since heat rises, the insertion depth of the lower electrode should be less than or equal to that of the upper electrode even in view of the fact that the heat-reflecting coating assists in heat conservation about the lower electrode. As has been pointed out above, arc tube 10 has been designed such that the "cold" or "cooler" spots will occur only within the middle region and not within either of the end regions of the arc tube.

During operation of a metal-halide lamp, condensate will form on the colder surfaces of the arc tube. Arc tube 12 has been designed such that the colder surfaces will be confined within region 54. This being the case, region 50, which includes the plane of the horizon, will be free of condensate during operation. Consequently, the azimuthal luminous intensity of arc tube 12 will be nearly uniform.

Heat-reflecting coating 28 serves the purpose of keeping region 52 hotter than region 54. This prevents condensate from collecting in a puddle about lower electrode 22 near point 30. If condensate were allowed to collect about lower electrode 22, the arc would migrate down electrode 22 toward point 30, which is undesirable because the operating arc will soften and eventually melt the arc tube wall near point 30. In the absence of coating 28, the coldest area within body 12 would be located about point 30. When coating 28 is present, the coldest area within body 12 is relocated to fall within region 54. This is the ideal location for the formation of condensate in this invention, because the location of the arc is unaffected and region 50 remains clear.

Other embodiments of the invention may employ a second heat-reflecting coating about top end 14 and the upper portion of region 50. This will cause region 50 to operate even hotter, which is beneficial. Point P may be moved slightly lower on axis V—V. The three thermal regions will not be altered functionally, and the arc tube will operate as described.

In FIG. 2, the horizontal shading of region 52 and double cross-hatching of region 54 are provided solely for identification of the thermal regions. Body 12, as has been mentioned, is formed entirely from light-transmissive material. Coating 28 may be opaque.

Referring to FIG. 1, arc tube 10 preferably is formed from quartz glass. Interior 18 may be sealed by means of press seals formed in ends 14 and 16. Suitable metal-to-glass seals may be obtained by employing molybdenum foils 36 within the press seals between tungsten electrodes 20 and 22 and tungsten lead-in wires 38 and 40. Gaseous fill 24, indicated by dots in the drawing, may be an inert gas, e.g., argon, which helps initiate an electrical discharge between the electrodes. The additive may be mercury with sodium/scandium iodide salts. Zirconium dioxide may be employed as a heat-reflecting coating. The gap length, G, preferably is approximately 7 millimeters. The top insertion ratio, T/G, is within the range of 0.35 to 0.43, inclusive; and the bottom insertion ratio, B/G, is within the range of .26 to .35, inclusive.

FIG. 3 is an elevational view of a single-ended embodiment of the invention. Lamp 100 comprises outer envelope 102 enclosing arc tube 10 which is mounted on lead-in wires 104 and 106. Lamp 100 may be constructed as follows.

Outer envelope 102 is shaped and contoured, as shown in FIG. 4, with exhaust tubulation 108 attached. Hard glass (7720 Nonex) tubing may be used. Envelope 102 encloses volume 120 within which arc tube 10 will be mounted.

In FIG. 5, arc tube assembly 110 is shown. After arc tube 10 has been constructed, it is mounted on lead-in wires 104 and 106, such as by welding. At least one of the lead-in wires, preferably return wire 106, may have a glass tube surrounding it. In the embodiment of FIG. 5, both lead-in wires 104 and 106 have fused glass coatings 112 and 114, respectively. Lead-in wires 104 and 106 preferably are tungsten because its coefficient of thermal expansion is close to that of the fused glass coating. The glass beaded lead-in wires add rigidity to assembly 110. This rigidity is advantageous for stabilizing the arc tube during the sealing of the outer envelope and for providing additional ruggedness to the lamp product. The beaded wires will also reduce sodium electrolysis and the possibility of voltage breakdown between the lead-in wires during operation of the lamp. The light-transmissive glass coating minimizes the amount of light shielded by the lead-in wire, particularly by return wire 106, which is important where uniformity of azimuthal intensity is sought. Getter 118 may be included to absorb hydrogen and oxygen which, if permitted to be in contact with the wall of the inner capsule, would diffuse into the capsule and create chemical reactions which would degrade the transmissive property of the capsule walls. Most getters of this type incorporate barium oxide.

Arc tube assembly 110 may be mounted within volume 120 of outer envelope 102. Arc tube 10 is properly centered by inserting tip 116 into tubulation 108. Bottom section 122 of envelope 102 is heated to the softening point of the glass, and metal jaws are collapsed against section 122 to form a hermetic press seal about lower portions 124 of the beaded lead-in wires. After volume 120 has been exhausted, flushed with hot nitrogen gas, and finally evacuated (low micron range), volume 120 may be filled and exhaust tubulation 108 sealed off. The fill gas may be pure dry nitrogen at an appropriate pressure, say 300 torr. The fill pressure within the outer envelope affects the thermal characteristics of arc tube 10 which during operation is cooled in part by convective flow within the outer envelope. Accordingly, the pressure of the fill within the outer envelope must be matched with the desired thermal properties of arc tube 10.

In FIG. 3, once the center of the arc has been aligned with respect to bi-post base 126 such that the arc will fall substantially along axis V—V, sealed envelope 102 may be mounted on base 126 with a suitable cement, such as Sauerisen 8, which when cured forms a tight and well insulated environment for the power leads. The thermal expansion coefficients of the glass envelope and cement should be nearly the same to avoid cracking the envelope at elevated temperatures. As a final step, the lead-in wires may be soldered to the bi-posts, such as by dipping bi-post tips 128 into a heated solder bath, e.g., 60/40 Pb/Sn solder, and trimming the lead-in wires. Slots 130 in the bi-posts provide means for vertically aligning lamp 100 in its socket.

A lamp of FIG. 3, in a specific non-limiting example of the invention, has been designed for the United States Coast Guard. This lamp will be used in existing 190 millimeter coastal signal beacons. A primary objective was to increase the range and azimuthal uniformity of the beacon signal without necessitating major hardware modifications. The light source currently employed is a 36 watt tungsten filament source. A larger filament source is not feasible, because it would generate too much heat for the beacon enclosure.

A 45 watt sodium/scandium arc discharge lamp was designed which can be retrofitted into existing beacon units. The metal-halide source provides substantially greater light output, and consequently greater range, while being more than twice as efficient as its filament counterpart. Additionally, the ballast for the arc source is designed to operate from storage batteries capable of being charged by solar cells. The arc discharge lamp has an operational life of approximately 4000 hours compared to approximately 1000 hours for the filament source. The geometry of the arc tube has been selected to provide an arc with greater horizontal and vertical plasma dimensions which increases the horizontal and vertical spreads of the beams emitted by the rotating beacon. The size of the discharge lamp is small, i.e., approximately the same as that of the existing filament source. The discharge lamp is rugged, capable of withstanding a high level of vibration. It has reliable starting and operating capabilities under all weather conditions in an isolated and exposed salt water environment.

FIG. 6 contains plots in polar coordinates of azimuthal luminous intensity of two light sources, each located at the center C of the graphs. Measurements were taken about a circle at a fixed distance from both light sources and adjusted to reflect the actual brightness of the source. The value of luminous intensity in a particular direction is represented by the magnitude of the radius pointing in that direction. Angular direction is measured clockwise from reference direction R, designated as 0°. Plot A represents an existing 36 watt filament source for the 190 mm coastal beacon signal. Plot B represents a 45 watt arc discharge source in accordance with the invention. The light sources in both cases were positioned with the maximum luminous intensity being emitted in the reference direction. The value of intensity at point X on Plot A is 140 kilocandela. The intensity value at point Y on Plot B is 200 kilocandela.

A comparison of the two plots of FIG. 6 shows two advantages of the invention over its prior art counterpart. First, luminous intensity is substantially higher in all directions, being an approximately 43 percent increase in the reference direction. Second, luminous intensity is much more uniform. Regarding the latter, Plot B is practically circular except for small deviations in the sector between 135°-200°. These deviations are attributable to light blocked by return wire 106 of FIG. 3. On the other hand, Plot A is significantly skewed (with reduced brightness) toward center C in the sector between 45°-225°. Although both plots will vary more or less depending on particular samples, the plots of FIG. 6 are fairly typical of the respective light sources. Thus, a beacon signal employing a light source as disclosed herein will have improved range and azimuthal uniformity of its signaling capability.

FIG. 7 is an enlarged elevational cross-sectional view of preferred embodiment 140 of an arc tube designed for use in a 45 watt coastal beacon signal. The drawing contains specific, but non-limiting, dimensions. For this embodiment, $X_1=0.095$, $X_2=0.185$, $X_3=0.225$, $X_4=0.245$, $X_5=0.215$, $X_6=0.155$, $Y_1=0.075$, $Y_2=0.150$, and $Y_3=0.225$. All dimensions are in inches and are approximate values.

FIG. 8 is an enlarged elevational view of arc tube 140 showing steady state operating temperatures at designated points $P_1$, $P_2$, . . . , $P_7$ on the surface of the arc tube. Arc tube 140 does not have a heat-reflecting coating on either end of the arc tube. The observed temperatures were as follows: at $P_1$, 525° C.; at $P_2$, 760° C.; at $P_3$, 792° C.; at $P_4$, 780° C.; at $P_5$ 755° C.; at $P_6$, 710° C.; and at $P_7$, 420° C.

These observations confirm that arc tube 140 does not operate isothermally. The temperatures above the horizon plane are hotter than those below the horizon plane, by about 25° C. or more. This temperature difference insures that the additive will condense below the horizon plane.

Arc tube 140 had no heat reflective coating about the top or bottom electrode because the infrared technique employed for measuring temperature would not provide reliable readings when the zirconium oxide coating was Present. Visual observations of operating arc tube 140 confirm that condensate did collect in a puddle about the bottom electrode when no coating was present. When a coating was employed on the bottom end about the lower electrode, the condensate relocated to an area on the arc tube wall above the coating and below the horizon plane.

The non-isothermal operation of arc tube 140 is not without some disadvantages. The non-uniform temperature distribution over the arc plasma encourages axial segregation of the metal-halide additive resulting in diminished color rendition (and possibly other disadvantages). See U.S. Ser. No. 891,410, filed July 31, 1986, being a continuation of U.S. Ser. No. 645,659, filed Aug. 30, 1984, now abandoned, both applications by Rothwell et al. Reasonable tradeoffs have been made in the design of the invention in order to obtain the level of uniformity of azimuthal luminous intensity exhibited in FIG. 6. A compromise, such as in color rendition, is not as important in signal lamps as may be the case with other applications. In other embodiments of the invention, arc tube and lamp parameters may be adjusted so that the arc tube will operate more closely to isothermal so that a compromise in color rendition or other lamp characteristic will be minimal.

FIG. 9 shows relative luminous intensity distributions measured horizontally across the center of the beam of a 190 mm coastal signal beacon. Distribution A represents a beam having a 36 watt filament source of the prior art. Distribution B represents a beam having an arc discharge source in accordance with the invention. Relative luminous intensity is plotted (on the vertical axis) as a function of angular deviation from the beam's center (on the horizontal axis). Beam width is defined in each case as that portion of the beam having relative intensity of 0.5 (half-intensity) or greater. It may be seen from the drawing that $W_A$, beam width for the filament source, is roughly one degree, whereas $W_B$, beam width for an arc source, is greater than two degrees.

Without modification of the beacon's lens, the beam width has been more than doubled by use of an arc source in comparison with a filament source. Beam width may be thought of as being the projected image of the light source. The arc tube of the invention provides a relatively wide plasma column which when projected by the beacon lens provides a wider beam than is the case with the filament source of the prior art.

The height of the beam, i.e., the vertical spread, is significant in a signal beacon. An observer on the surface of the earth at a distance from the signal will be below the azimuthal plane because of the earth's curvature. With a light source in accordance with the invention, uniformity of azimuthal luminous intensity will be maintained even below the azimuthal plane. The lens of the rotating beacon inverts its image, so that the clean top region of the arc tube will be projected below the azimuthal plane. The greater the height of the arc above the azimuthal plane, the greater will be the spread of the beam below the azimuthal plane.

During operation of a sodium/scandium metal-halide lamp, particularly during initial startup, the additive may react with the arc tube wall resulting in a permanent residue or opaque stain residing on the wall. This stain is believed to be caused by a reaction between the scandium chip and free silica. The stain diminishes the light-transmissiveness of the wall underneath the stain. Steps must be taken to insure that there is no additive adhering to the walls of the top region of the arc tube at initial startup of the lamp. FIG. 10 shows block diagram 150 outlining five steps which may be taken to season an arc tube or lamp in accordance with the invention to insure that an opaque stain will not form on a wall of the top region of the arc tube at any time during the life of the lamp.

In step 1, outlined in block 152, the arc tube is placed into its operating position. In step 2, outlined in block 154, the arc tube is vibrated or tapped such that any additive adhering to the walls of the top region of the arc tube will be dislodged therefrom. The dislodged additive will fall into the lower regions of the arc tube below the horizon plane. In step 3, outlined in block 156, appropriate electrical power is applied to the arc tube until all of the additive goes into the liquid and vapor states. In step 4, outlined in block 158, the power is turned off. In step 5, outlined in block 160, the arc tube is allowed to cool while remaining in the operating position. Because the lower regions are colder than the top region, the additive will condense, solidify, and adhere to the walls in the lower regions of the arc tube.

After an arc tube or lamp has been seasoned in accordance with the method of FIG. 10, the additive will remain securely bonded to the walls of the lower regions of the arc tube even during shipping and installation. Once an arc tube or lamp of the invention has been installed, the additive will be confined to the lower regions of the arc tube for the life of the lamp notwithstanding intermittent operation. The seasoning may be conducted as the last step of the manufacturing process which will insure uniformity of azimuthal luminous intensity in lamps operating in the field.

FIG. 11 is an elevational view of a double-ended embodiment of the invention. Lamp 170 for vertical operation comprises elongated outer envelope 172, such as T8 tubing, having top end 174 opposing bottom end 176. Lamp 170 has central vertical axis V—V. Mounted within outer envelope 172 is arc tube 12 in operating position supported by lead-in wires 178 and 180. One or both lead-in wires may be surrounded by glass or metal sleeve 182, e.g., nickel, within outer envelope 172 for additional rigidity. Getter 186, for gettering hydrogen and oxygen, may be mounted and positioned near the bottom end of arc tube 12, as shown in the drawing. Outer envelope 172 may be hermetically sealed about lead-in wires 178 and 180, such as by press seals in ends 174 and 176. The glass-to-metal seals require matching of the coefficients of thermal expansion of the materials of the outer envelope and lead-in wires, such as Nonex glass and tungsten wire, respectively. Gaseous fill 184 may be included within outer envelope 172; fill 184 may be dry nitrogen at 300 torr. Electrically conductive bases 186 may be mounted on ends 174 and 176 with an appropriate adhesive, and electrical contacts may be made between the lead-in wires and bases, e.g., by soldering or welding. An azimuthal plane H—H, normal to axis V—V, passes midway between the internal terminations of the electrodes of arc tube 12.

Lamp 170 is an alternate embodiment of the invention which may be constructed with all of the features, e.g., ruggedness, discussed above. If lamp 170 is employed with a rotating signal beacon, the electrical return wire will cross plane H—H at some point outside of the lamp. Since an outside return wire will be farther from the light source than an equivalent return wire within the outer envelope, the amount of light blocked by the return wire is somewhat less in the double-ended embodiment. The mechanical arrangement, however, is slightly more cumbersome, and consequently the single-ended embodiment presently is preferred.

While there have been shown what are at present considered to be preferred embodiments of the invention, it will be apparent to those skilled in the art that various changes and modifications can be made herein without departing from the scope of the invention as defined in the appended claims.

We claim:

1. An arc tube for vertical operation having improved uniformity of azimuthal luminous intensity, said arc tube having a vertical axis and an azimuthal plane normal to said vertical axis, said arc tube comprising:

(a) a light-transmissive body elongated along said vertical axis with opposed top and bottom ends, said bottom end being closer to the earth than said top end when said arc tube is operationally positioned, said body hermetically enclosing an interior, said top end having an electrode mounted therein which protrudes into said interior substantially along said vertical axis a distance of approximately T millimeters, said bottom end having an electrode mounted therein which protrudes into said interior substantially along said vertical axis a distance of approximately B millimeters, there being a distance along said vertical axis between the internal terminations of said top and bottom electrodes of approximately G millimeters, wherein the ratio T/G is less than or equal to 0.5, the ratio B/G is less than or equal to 0.5, and B is less than or equal to T, said azimuthal plane passing half way between the internal termination points of said electrodes, the portion of said body below said azimuthal plane being more oblate than the portion of said body above said azimuthal plane, said body being divided into three regions all symmetrical about said vertical axis, a top region extending from said top end to a point on said body below said azimuthal plane, a bottom region extending from said bottom end toward said top region, and a middle region being intermediate said bottom and top regions;

(b) a heat-reflecting coating on the outside surface of said bottom region;

(c) a gaseous fill disposed within said interior, said fill being capable of sustaining an electrical arc therethrough;

(d) an additive including at least one metal-halide disposed within said interior;

(e) during operation of said arc tube, the inside surface of said top region being substantially free of said additive in condensate form; and (f) means for providing electrical power from an external source to said electrodes.

2. An arc tube as described in claim 1 wherein during operation said additive in condensate form is substantially confined within said middle region.

3. An arc tube as described in claim 1 wherein said arc tube has been seasoned by means of the following steps in the following order:

(a) before the first application of said electrical power to said arc tube, placing said arc tube into its operating position;

(b) vibrating said arc tube such that any of said additive disposed on an inside surface of said top region will be dislodged therefrom and collected along said bottom and middle regions;

(c) applying said electrical power to said arc tube for a period sufficient for substantially all of said additive to be in liquid and vapor states;

(d) discontinuing said electrical power; and (e) cooling said arc tube while it remains in its operating position such that all of said additive becomes solidified and securely adhered to said bottom and middle regions.

4. A metal-halide arc discharge lamp for vertical operation having improved uniformity of azimuthal luminous intensity, said lamp having a vertical axis and an azimuthal plane normal to said vertical axis, said lamp comprising:

(a) a hermetically sealed light-transmissive outer envelope;

(b) an arc tube mounted within said outer envelope, said arc tube including:

(i) A light-transmissive body elongated along said vertical axis with opposed top and bottom ends, said bottom end being closer to the earth than said top end when said arc tube is operationally positioned, said body hermetically enclosing an interior, said top end having an electrode mounted therein which protrudes into said interior substantially along said vertical axis a distance of approximately T millimeters, said bottom end having an electrode mounted therein which protrudes into said interior substantially along said vertical axis a distance of approximately B millimeters, there being a distance along said vertical axis between the internal terminations of said top and bottom electrodes of approximately G millimeters, wherein the ratio T/G is less than or equal to 0.5, the ratio B/G is less than or equal to 0.5, and B is less than or equal to T, said azimuthal plane passing half way between said internal termination points of said electrodes, the portion of said body below said azimuthal plane being more oblate than the portion of said body above said azimuthal plane, said body being divided into three regions all symmetrical about said vertical axis, a top region extending from said top end to a point on said body below said azimuthal plane, a bottom region extending from said bottom end toward said top region, and a middle region being intermediate said bottom and top regions;

(ii) a heat-reflecting coating on the outside surface of said bottom region;

(iii) a gaseous fill disposed within said interior, said fill being capable of sustaining an electrical arc therethrough;

(iv) an additive including at least one metal-halide disposed within said interior;

(v) during operation of said arc tube, the inside surface of said top region being substantially free of said additive in condensate form; and (vi) means for providing electrical power from an external source to said electrodes;

(c) means for mounting said arc tube within said outer envelope; and (d) means for structurally and electrically completing said lamp.

5. A lamp as described in claim 4 wherein during operation said additive in condensate form is substantially confined within said middle region of said arc tube.

6. A lamp as described in claim 4 wherein said arc tube has been seasoned by means of the following steps in the following order:

(a) before the first application of said electrical power to said arc tube, placing said arc tube into its operating position;

(b) vibrating said arc tube such that any of said additive disposed on an inside surface of said top region will be dislodged therefrom and collected along said bottom and middle regions of said body;

(c) applying said electrical power to said arc tube for a period sufficient for substantially all of said additive to be in liquid and vapor states;

(d) discontinuing said electrical power; and (e) cooling said arc tube while it remains in its operating position such that all of said additive becomes solidified and securely adhered to said bottom and middle regions.

7. A lamp as described in claim 4 wherein there is a gaseous fill within said outer envelope.

8. A lamp as described in claim 4 wherein said lamp includes two lead-in wires within said outer envelope, at least one of said lead-in wires having a glass coating thereon.

9. A lamp as described in claim 4 wherein said lamp is single-ended.

10. A lamp as described in claim 4 wherein said lamp includes a bi-post base.

11. A lamp as described in claim 10 wherein the wattage of said lamp is 45 watts.

12. A lamp as described in claim 11 wherein said lamp is used as a light source for a navigational beacon signal.

* * * * *